US011019914B2

(12) United States Patent
Swan et al.

(10) Patent No.: US 11,019,914 B2
(45) **Date of Patent: *Jun. 1, 2021**

(54) GEAR TRACK SYSTEM

(71) Applicant: S&S Precision, LLC, Virginia Beach, VA (US)

(72) Inventors: Johnny E. Swan, Virginia Beach, VA (US); Andrew C. Borland, Virginia Beach, VA (US); William-Joseph Basan Elizalde, Virginia Beach, VA (US)

(73) Assignee: S&S Precision, LLC, Virginia Beach, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/291,701

(22) Filed: Mar. 4, 2019

(65) Prior Publication Data

US 2019/0208897 A1 Jul. 11, 2019

Related U.S. Application Data

(63) Continuation of application No. 14/496,575, filed on Sep. 25, 2014, now Pat. No. 10,238,201.
(Continued)

(51) Int. Cl.
*A45F 5/02* (2006.01)
*F41C 33/04* (2006.01)
(Continued)

(52) U.S. Cl.
CPC ..... *A45F 5/02* (2013.01); *A41D 1/04* (2013.01); *A41D 13/05* (2013.01); *A41D 13/0518* (2013.01); *A41D 13/0531* (2013.01); *A41F 9/00* (2013.01); *A45F 3/14* (2013.01); *A45F 5/00* (2013.01); *F41C 33/041* (2013.01); *A45F 2003/146* (2013.01); *A45F 2200/0591* (2013.01)

(58) Field of Classification Search
CPC .. A45F 5/02; A45F 2200/0591; F41C 33/041; A41D 1/04; A41D 13/0518; A41D 13/0531; A41D 13/05; A41F 9/00; A34F 3/005
USPC ..... 224/660
See application file for complete search history.

(56) References Cited

U.S. PATENT DOCUMENTS

D588,801 S * 3/2009 Cicione ..... D3/228
7,780,048 B2 * 8/2010 Howell ..... A41D 13/0012 224/242
(Continued)

*Primary Examiner* — Nathan J Newhouse
*Assistant Examiner* — Lester L Vanterpool
(74) *Attorney, Agent, or Firm* — Tanner IP, PLLC

(57) ABSTRACT

Systems for holding tactical gear, such as firearm magazines, weapons, etc., and for connecting such holders to a harness are described and may include a carrier, and an accessory holder that is configured to attach to the carrier. The carrier and/or the accessory holder may be formed from substantially rigid materials, such as plastic or the like, and may be configured to be easily attached and detached from one another, using preconfigured, integral connectors. The connectors may be configured to resist rotation of the carrier and accessory holder with respect to each other, and/or to secure the accessory holder at a fixed angle with respect to the carrier. The accessory holder may also include flanges, surface treatments, or other features, that assist in holding the accessory in the holder.

18 Claims, 11 Drawing Sheets

Related U.S. Application Data

(60) Provisional application No. 61/882,405, filed on Sep. 25, 2013.

(51) Int. Cl.

| | |
|---|---|
| ***A41D 1/04*** | (2006.01) |
| ***A41F 9/00*** | (2006.01) |
| ***A41D 13/05*** | (2006.01) |
| ***A45F 5/00*** | (2006.01) |
| ***A45F 3/14*** | (2006.01) |

(56) References Cited

U.S. PATENT DOCUMENTS

| | | | | |
|---|---|---|---|---|
| 8,011,545 | B2 * | 9/2011 | Murdoch | B25H 3/00 224/672 |
| 8,322,065 | B2 * | 12/2012 | Faifer | F41A 9/63 42/90 |
| D677,433 | S * | 3/2013 | Swan | D29/100 |
| 8,776,291 | B1 * | 7/2014 | Lewis | A61G 1/044 5/628 |
| 2009/0277936 | A1 * | 11/2009 | Rogers | A45F 5/02 224/191 |
| 2012/0175391 | A1 * | 7/2012 | Rogers | F41C 33/045 224/182 |
| 2013/0181019 | A1 * | 7/2013 | Salentine | A45F 5/021 224/242 |
| 2013/0206806 | A1 * | 8/2013 | Hu | A62B 18/006 224/662 |
| 2014/0027480 | A1 * | 1/2014 | Van Heusen | A45F 5/02 224/191 |
| 2015/0157117 | A1 * | 6/2015 | Seuk | A45F 3/06 224/182 |
| 2015/0369567 | A1 * | 12/2015 | Hall | F41H 1/02 89/36.05 |

* cited by examiner

GEAR TRACK SYSTEM

RELATED APPLICATIONS

This application is a continuation application of U.S. application Ser. No. 14/496,575 filed Sep. 25, 2014, and entitled "Gear Track System," which claims benefit under 35 USC 119(e) of U.S. Provisional Patent Application Ser. No. 61/882,405, filed Sep. 25, 2013, and entitled "Gear Track System," the contents of each of which are hereby incorporated by reference in their entireties.

BACKGROUND OF THE INVENTION

The present invention generally relates to tactical gear retention systems, such as used for holding firearm magazines, ordnance, weapons, and other tactical equipment.

There is an ongoing need to provide tactical gear retention systems that securely hold various equipment in a secure, yet readily accessible, manner. Moreover, there are ongoing needs for such systems to be reconfigurable to adapt to various operational requirements and personal preferences.

Current military and law enforcement units are required to wear tactical vest that accommodate a variety of mission essential equipment. Most of these extra pieces of equipment are typically carried by pouches worn by the individual. These pouches, plus the hard and soft armor pieces are attached to the upper torso of an individual via a soft material sewn in such a fashion that it carries these pieces. These are typically referred to as a load bearing vest or tactical vest. In an attempt to meet the demands of carrying a variety of tactical equipment, manufacturers must make tactical vest designs that have a modular attachment system and in doing so this adds unnecessary material and bulk to the tactical vest.

The materials sewn are also not resistant to the absorption of liquids and chemicals. Once these materials become impregnated with a liquid that is harmful, they are considered useless and disposed of promptly. If the same tactical nylon material is immersed in water, it absorbs a substantial amount of water and takes on that unnecessary weight until it can be dried out.

As the demand increases to decrease the overall weight of this equipment and provide resistance to liquids and chemicals, the need exist to provide military and law enforcement units with a streamlined system to carry equipment and, in particular, AR-15 and other style magazines, ordnance and equipment.

AR-15, and other firearm, magazines are typically carried via pouches that may be sewn in such a way that they form a snug fit around the magazines' body. The material most commonly used to sew theses pouches is a woven nylon. A sewn tactical vest may accommodate these sewn pouches and/or have one large pouch on the front side of the vest which is referred to as the kangaroo pouch. This kangaroo pouch is approximately wide enough to receive three AR-15 magazines laid side by side in a vertical orientation. Although it is wide enough to hold 3 magazines, it is usually loosely fitted and therefore provides little to no retention. This is yet one example demonstrating the ongoing need to provide improved magazine retention, stability and speed of access in a light weight design for the kangaroo pouch.

The present subject matter overcomes at least some aspects of the historical challenges in this area by providing novel configurations related to, for example, tactical gear retention systems using skeletonized equipment holders that quickly and securely attach to standardized mounting platforms, such as chest carriers, belt mounts, leg mounts, plates, etc.

BRIEF SUMMARY OF THE INVENTION

According to first aspects of the invention, a system for connecting accessories to a harness may include one or more of a carrier configured for wearing on a user's body or otherwise mounting to tactical equipment; an accessory holder configured to attach to the carrier via a first connector fixedly attached to the accessory holder, and a second connector fixedly attached to the carrier; and a release mechanism for releasing the accessory holder from the carrier.

In embodiments, the first connector and second connector may be configured to engage with one another so as to allow the accessory holder to be mounted to and removed from the carrier.

In embodiments, the first connector and second connector may be attachable to one another using a male member of the first connector and a female member of the second connector, or vice versa.

In embodiments, the first connector and second connector may be configured to resist rotation relative to one another when the first connector and second connector are engaged.

In embodiments, the release mechanism may include at least one deflecting component integrally formed or joined with the accessory holder or carrier and configured to be manipulated by a user's finger to allow the accessory holder to be removed from the carrier.

In embodiments, the carrier may be at least one of a chest, side or back plate, a load bearing equipment, a belt, a vest, a ballistic plate carrier, a backpack, a harness, and/or a holster.

In embodiments, the second connector may be a substantially monolithic piece of molded, machined, cast, or 3-D patterned plastic or similar material affixed to the carrier.

In embodiments, the accessory holder may be configured to receive and fixedly hold at least one of a firearm magazine, a radio, a tool, a grenade, a weapon system, ordnance, or other tactical equipment or ordnance.

In embodiments, the accessory holder may be a substantially monolithic piece of molded, machined, cast, or 3-D patterned plastic or similar material.

In embodiments, each of the accessory holder and the second connector may be substantially monolithic pieces of molded, machined, cast, or 3-D patterned plastic or similar material.

In embodiments, the carrier may include a plurality of second connectors arranged in fixed positions on the carrier and configured to mount a plurality of accessory holders thereto.

In embodiments, the carrier may be substantially plate-shaped and may include a plurality of slots disposed around the perimeter and/or a plurality of pockets on the front or back thereof.

In embodiments, the accessory holder may be configured to resist rotation relative to the carrier when attached to the harness and/or carrier, and/or may be configured to be secured at a fixed angle with respect to the carrier.

In embodiments, the carrier may have a front face and the accessory holder may have a back face that are substantially flush with one another when the male member is seated in the female member.

According to further aspects of the invention, an accessory holder may include one or more of a frame including a plurality of elongated members that at least partially define a cavity sized and configured to receive an accessory such as a firearm, a firearm magazine, a radio, a tool, a grenade, or other tactical equipment or ordnance; and a connector fixedly attached to the frame.

In embodiments, the connector may include at least one of a male or female component configured to allow the accessory holder to be mounted to and removed from a carrier with a complimentary connector.

In embodiments, the frame may be a substantially monolithic piece of molded, machined, cast, or 3-D patterned plastic or similar material.

In embodiments, the connector may be a substantially monolithic piece of molded, machined, cast, or 3-D patterned plastic or similar material.

In embodiments, the connector may include an edge that is configured to deflect a surface of the complimentary connector during attachment and to positively engage the complimentary connector in a fully seated configuration.

Embodiments may include a release mechanism for releasing the accessory holder from the carrier.

In some examples, the release mechanism may include at least one deflecting component integrally molded or formed with the accessory holder and configured to be manipulated by a user's finger to allow the accessory holder to be removed from the carrier.

In embodiments, the connector may be configured to resist rotation relative to the carrier when mounted.

In embodiments, the frame may define an opening sized and configured for insertion and removal of the accessory, and the frame may include one or more members projecting from the opening and angled generally toward the middle of the opening so as to pinch the accessory when inserted in the holder.

In embodiments, the frame may include at least one interior surface with a friction-enhancing treatment and/or material facing the cavity.

In embodiments, the cavity may have a substantially rectangular cross section, and the frame may include a friction-enhancing treatment and/or material on an interior surface extending through one edge of the rectangle. In embodiments, the frame may not include the friction-enhancing treatment and/or material on interior surfaces extending through the other three edges of the rectangle.

Embodiments may include a release mechanism for releasing the accessory from the carrier and/or accessory holder.

According to further aspects of the invention, a tactical equipment carrier may include one or more of a mounting surface; and a plurality of similarly configured connectors arranged in fixed positions on the mounting surface and configured to mount a plurality of accessory holders thereto.

In embodiments, the connectors may include at least one of male or female members configured to engage with complimentary components of the accessory holders.

In embodiments, the connectors may include at least one of an edge that is configured to deflect a surface of the complimentary components during attachment and to positively engage the complimentary components in a fully seated configuration, and/or a release mechanism for releasing the accessory holder from the carrier.

In embodiments, each of the plurality of connectors may be configured to hold the complimentary components of the accessory holders in a manner that resists removal and rotation of the accessory holders.

In embodiments, the release mechanism may include at least one deflecting component integrally formed or joined with the carrier and configured to be manipulated by a user's finger to allow the accessory holder to be removed from the carrier.

In embodiments, the carrier may be at least one of a chest, side or back plate, a load bearing equipment, a belt, a vest, a ballistic plate carrier, a backpack, a harness, and/or a holster.

In embodiments, the connectors may be each, and/or collectively, a substantially monolithic piece of molded, machined, cast, or 3-D patterned plastic or similar material affixed to the carrier.

In embodiments, the accessory holder may be configured to hold at least one of a firearm, a firearm magazine, a radio, a tool, a grenade, or other tactical equipment or ordnance.

In embodiments, the carrier may be substantially plate-shaped and may include a plurality of slots disposed around the perimeter and/or a plurality of pockets on the front or back thereof.

In embodiments, the carrier may have a front face and the accessory holder may have a back face that are substantially flush with one another when the male member is seated in the female member.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention claimed. The detailed description and the specific examples, however, indicate only preferred embodiments of the invention. Various changes and modifications within the spirit and scope of the invention will become apparent to those skilled in the art from this detailed description.

BRIEF DESCRIPTION OF THE DRAWINGS

The accompanying drawings, which are included to provide a further understanding of the invention, are incorporated in and constitute a part of this specification, illustrate embodiments of the invention and together with the detailed description serve to explain the principles of the related technology. No attempt is made to show structural details of technology in more detail than may be necessary for a fundamental understanding of the invention and various ways in which it may be practiced. In the drawings.

DETAILED DESCRIPTION OF THE INVENTION

Figure 1:
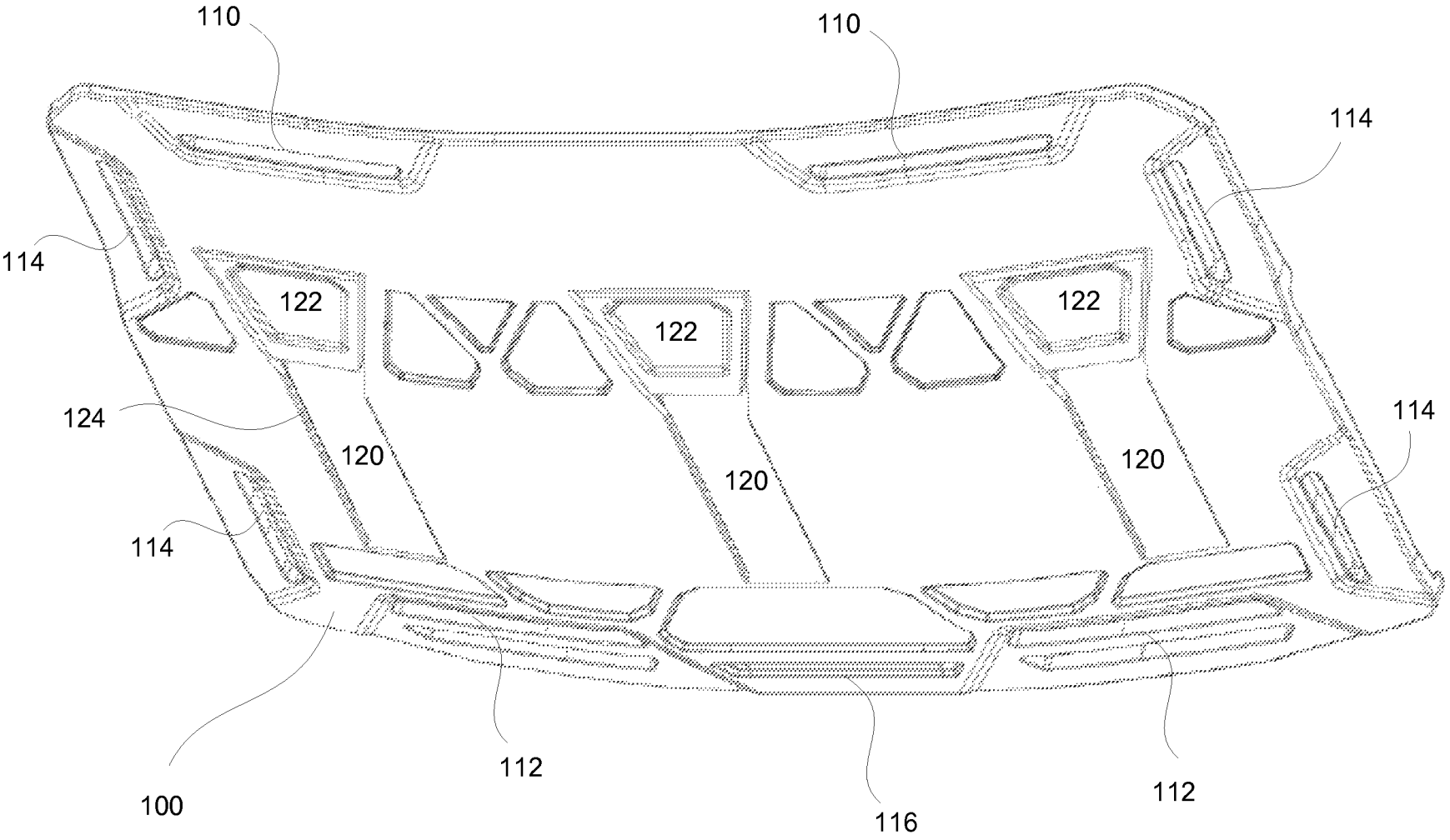
FIG. 1 is an isometric view of an exemplary carrier plate according to aspects of the invention.

It is understood that the invention is not limited to the particular methodology, protocols, etc., described herein, as these may vary as the skilled artisan will recognize. It is also to be understood that the terminology used herein is used for the purpose of describing particular embodiments only, and is not intended to limit the scope of the invention. It also is to be noted that as used herein and in the appended claims, the singular forms "a," "an," and "the" include the plural reference unless the context clearly dictates otherwise. Thus, for example, a reference to "a support member" is a reference to one or more support members and equivalents thereof known to those skilled in the art.

Unless defined otherwise, all technical terms used herein have the same meanings as commonly understood by one of ordinary skill in the art to which the invention pertains. The embodiments of the invention and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law.

Various skeletonized magazine retention (SMR) systems are described herein, which may provide magazine, and other equipment, retention in a modular platform. In some examples, this may require no extra flap of material or cover to ensure the magazine, or equipment, stays in place. Therefore, leaving the item partially exposed for ease and speed of access. The SMR may comprise a modular base plate and multiple, e.g. 3, individual magazine retention devices (MRD). Additional accessories would include any device that the track system could be adapted to (i.e. magazines of a different caliber/size, tools, communication devices, etc.). Therefore, while magazine holders may be described in exemplary embodiments for ease of understanding, it should also be understood that the invention is not necessarily limited to such embodiments, and may be applied to a variety of equipment retention devices, such as holders for firearms, radios, tools, grenades, weapons systems, ordnance, or other tactical equipment.

Figure 2:
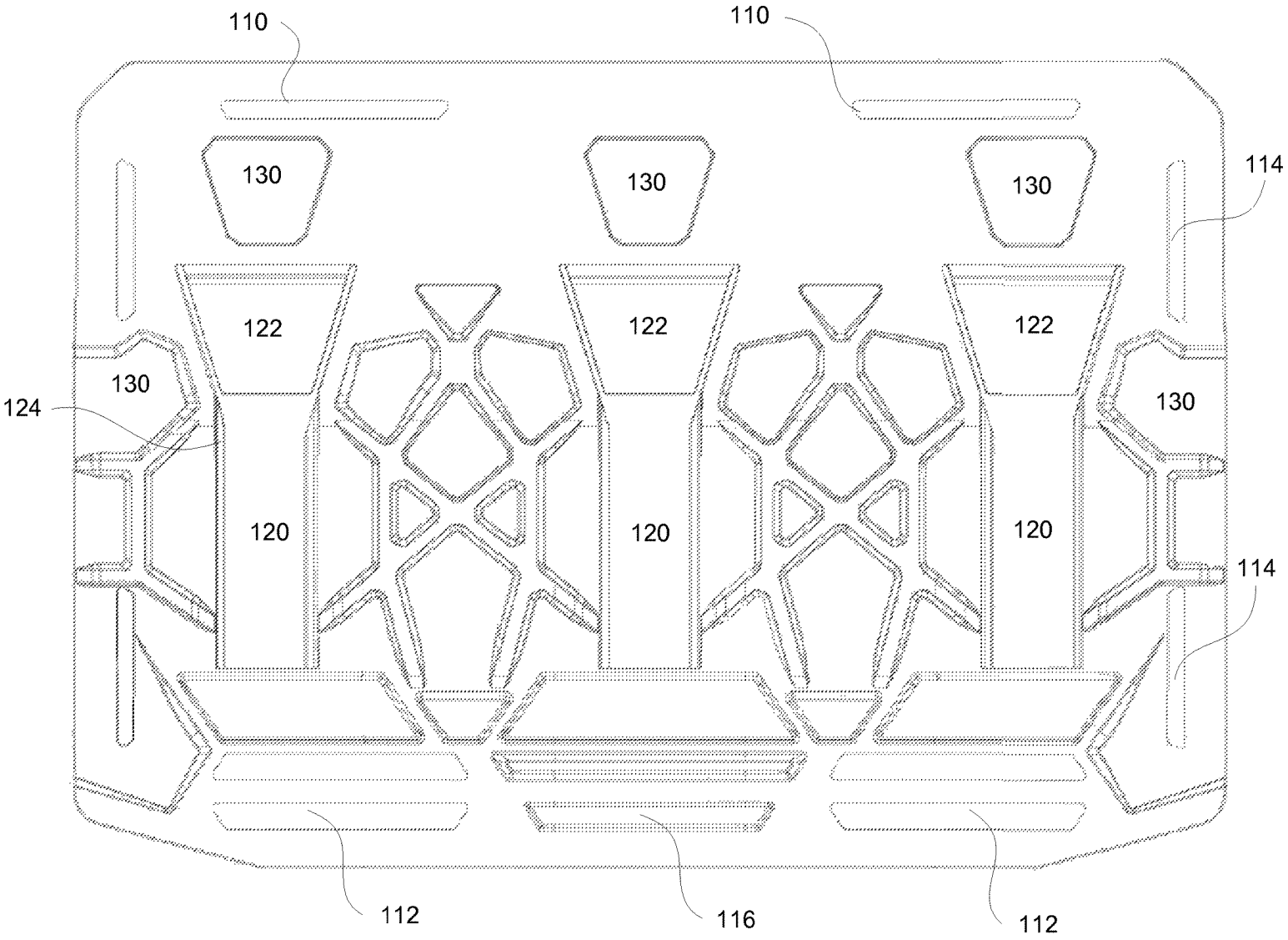
FIG. 2 is a rear view of an exemplary carrier plate according to aspects of the invention.

FIGS. 1 and 2 show an exemplary base plate 100 comprising a connector mechanism for attaching multiple accessory holders thereto. In this case, base plate 100 includes a plurality of female track systems, each having an open track 120, a deflecting component 122, and side edges 124. The female track systems (or other connector) may be configured to receive a corresponding connector for an accessory holder, in order to mount the accessory holder(s) to the base plate 100.

As shown in FIG. 1, the base plate 100 (or other carriers described herein) may include a plurality of connectors arranged in fixed positions on the carrier and configured to mount a plurality of accessory holders thereto. In the example shown in FIG. 1, there are three separate tracks 120 (although other numbers are possible), which can be used to mount a variety of individual accessory holders and/or to mount one or more accessory holders with multiple male connectors (e.g. holders for larger accessories may require more space on the carrier and/or may require additional stability/strength and can use two or more tracks).

The base plate 100 may have a plurality of slots around its perimeter, e.g. top slots 110, bottom slots 112, side slots 114 and/or middle-bottom slot 116, which may be used, for example, as points to fixedly sew the base plate to soft material, run flat material through to hang the base plate from something or someone, etc. The horizontal top slots 110 may be used to run shoulder or other straps through, to secure the base plate 100 to an armor plate carrier or other harness, etc. The vertical side slots 114 can be used, for example, to run material through and use the same to hold the base plate steady along the waist area, around a leg or arm, on a belt, etc. Middle-bottom slot 116 may be used to secure a piece of webbing running between a user's legs. In some examples, recesses may be formed proximate to slots 110, 112, 114 and/or 116, e.g. to accommodate webbing, buckles or other mounting accessories, to receive clips, etc. In addition, or as an alternative, to the slots shown in FIGS. 1 and 2, other mounting means may be formed in or attached to base plate 100, such as female clip sockets, male clip connectors, additional female tracks, male tracks, etc.

In embodiments, the base plate 100, or other carriers described herein, may be included (e.g. attached to or integrally formed in) a chest, side or back plate, a load bearing equipment, a belt, a vest, a ballistic plate carrier, a backpack, a harness, and/or a holster.

As shown in FIGS. 1 and 2, a female-style track 120 may be a substantially monolithic piece of molded, machined, cast, or 3-D patterned plastic or similar material affixed to the base plate 100, or other carrier. The base plate 100 may also include various locking mechanisms e.g. to hold the base plate 100 to a plate carrier or other harness, to secure an accessory holder to the base plate 100 in a releasable manner, etc. In the example shown in FIG. 1, a deflecting component 122 is disposed at the top of each of the female tracks 120, which prevents a male track from sliding out of the female track 120 until depressed. In some examples, the locking mechanism(s), such as deflecting component 122, may be integrally formed with the carrier.

Figure 3:
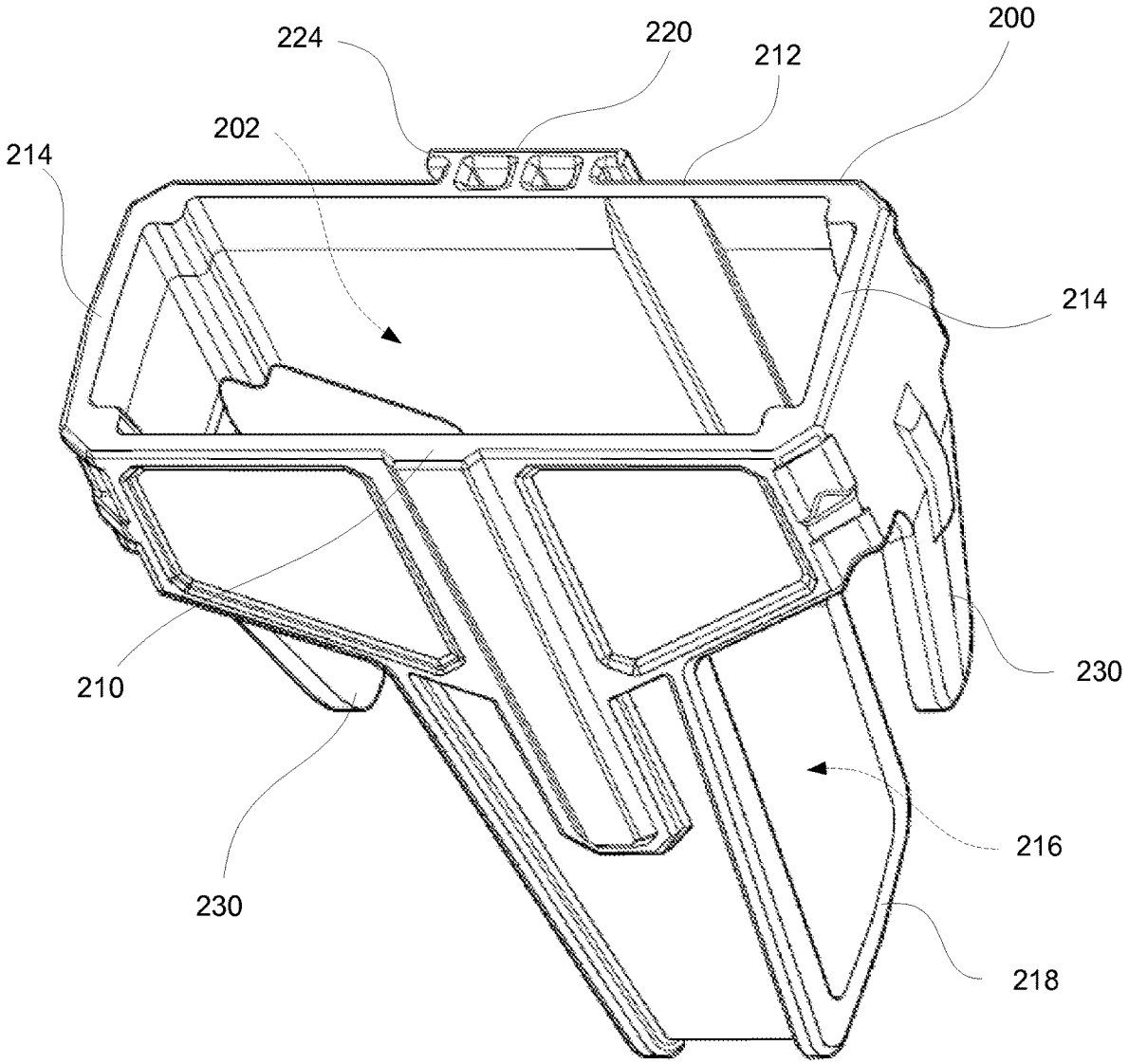
FIG. 3 is an isometric view of an exemplary firearm magazine holder according to aspects of the invention.
Figure 4:
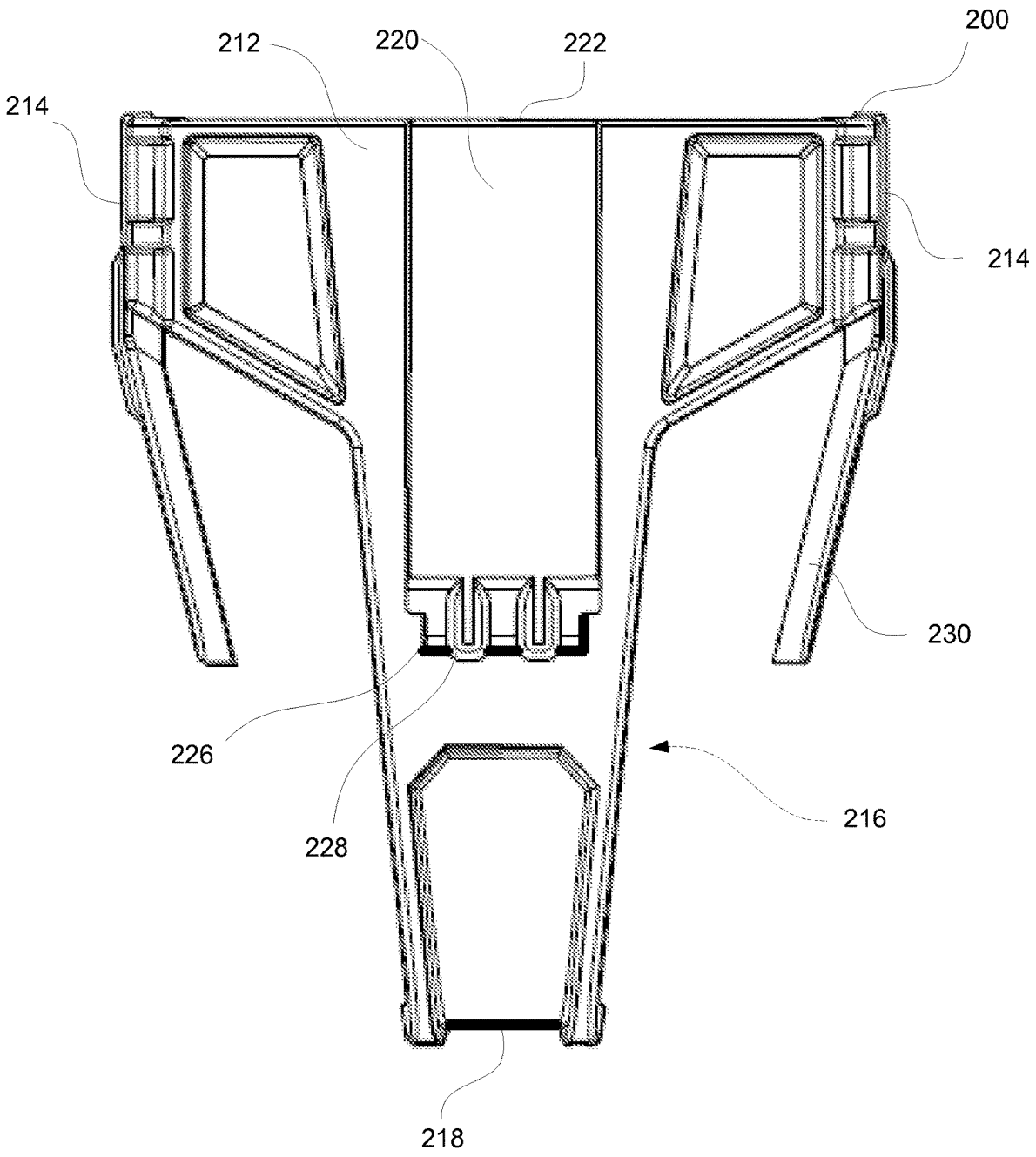
FIG. 4 is a rear view, showing additional details of the firearm magazine holder shown in FIG. 3.

One example of an accessory holder than may be used with base plate 100, or other carrier, is shown in FIGS. 3 and 4.

FIGS. 3 and 4 show an exemplary magazine retention device (MRD) 200. As noted previously, aspects of the MRD 200 may also be applied more generally to an accessory holder that may be configured to receive and fixedly hold accessories such as a weapon, a radio, a tool, a grenade, a weapon system, ordnance, or other tactical equipment or ordnance. In some embodiments, the MRD 200, or accessory holder, may be a substantially monolithic piece of molded, machined, cast, or 3-D patterned plastic or similar material.

FIG. 3 is an isometric front view of the MRD 200, and FIG. 4 shows a back view of the MRD 200 showing the surface that mounts toward the wearer or carrier and that includes the male track connector 220 with top edge 222, side rails 224, chamfered edge 226 and stops 228.

In embodiments, the MRD 200 may be formed from a plurality of elongated members that generally form a full or partial ring (at least partially defining a top opening) and a well. In the example shown in FIG. 3, a top opening 202 may be defined by front wall 210, back wall 212 and sidewalls 214. In this example, a well 216 is also partially formed by elongated extensions of front wall 210 and rear wall 212 joined together by bottom 218.

In embodiments, the MRD 200 includes a male track connector configured to interface with a female track connector (however it could also include a female track, or other connector). The male track connector 220 includes side rails 224 that can engage with complimentary sides of a female track to prevent the MRD 200 from being pulled away from the carrier and to assist with inhibiting rotation of the MRD 200 with respect to the carrier.

The male track connector 220 may have a chamfered lead-in edge 226 that disengages/depresses the female tracks' locking mechanism (e.g. component 122) as physical pressure is applied.

The male track connector 220 may also include stops, such as stops 228, to prevent the male track from continuing past its final location in the female track.

The male connector and female connector may be configured to engage with one another so as to allow the accessory holder, such as MRD 200, to be mounted to and removed from the carrier, such as base plate 100. In some embodiments, a male connector may be included in the carrier, and a female connector included in the accessory holder. In some embodiments, other complimentary connectors may also be used, consistent with other aspects of the invention.

The MRD shown in FIGS. 3 and 4 includes a frame with a plurality of elongated members that at least partially define a cavity sized and configured to receive a magazine, or other accessory having a substantially rectangular cross section. However, other embodiments may include accessory holders with one or more elongated members that at least partially define a cavity with other cross sections, such as those sized and configured to receive a firearm, a revolver reloader, a radio, a tool, a grenade, other tactical equipment or ordnance, etc.

In embodiments, the frame (including front wall 210, back wall 212, sidewalls 214 and well 216, and/or male connector 220, such as shown in FIGS. 3 and 4, may be a substantially monolithic piece of molded, machined, cast, or 3-D patterned plastic or similar material.

As also shown in FIGS. 3 and 4, the frame may define an opening 202 sized and configured for insertion and removal of an accessory, such as a magazine, and the frame may include one or more members projecting from the opening 202 and angled generally toward a middle of the opening so as to pinch the accessory when inserted in the holder. In this case, deflecting flanges 230 project at least partially into the cavity that is sized to accommodate the accessory. When the accessory is inserted through the opening 202 and into the cavity, the flanges 230 are deflected outward by contact with the accessory and maintain a positive pressure on the accessory to assist with holding the accessory in the holder. In some examples, a single flange (or more than two flanges) may be used for similar purposes.

The male 220 connector included in the MRD 200 may include an edge 226 that is configured to deflect a surface of the complimentary connector during attachment, and a top edge 222 that is configured to positively engage the complimentary connector in a fully seated configuration.

Figure 5:
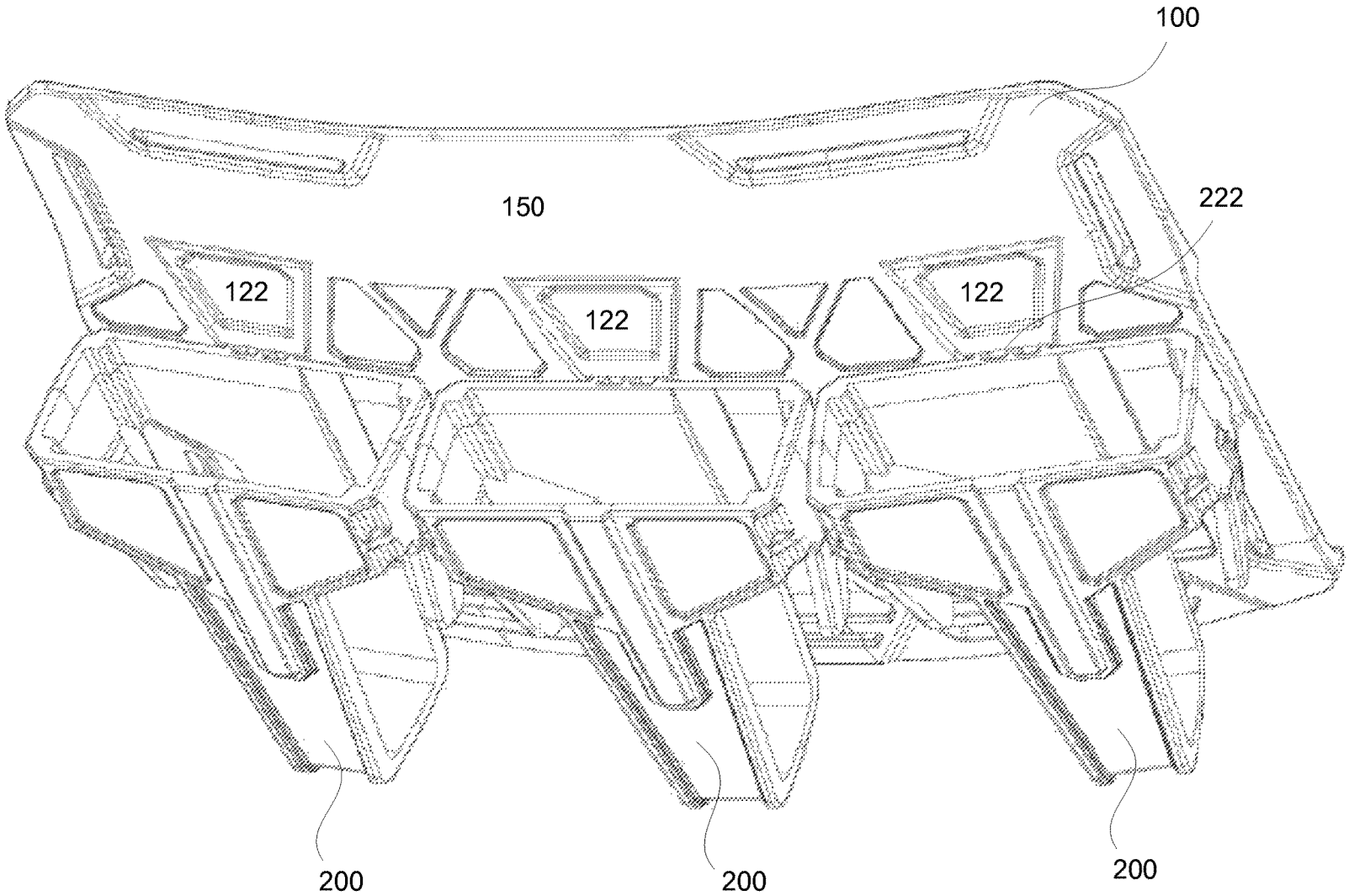
FIG. 5 is an isometric view of an exemplary carrier plate with several firearm magazine holders attached thereto according to aspects of the invention.

FIG. 5 shows an exemplary system for connecting accessories to a harness including a carrier configured for wearing on a user's body or otherwise mounting to tactical equipment; and three accessory holders configured to attach to the carrier via a male connector fixedly attached to the accessory holder, and a female connector fixedly attached to the carrier. As mentioned above, the carrier may also have a release mechanism for releasing the accessory holder from the carrier. In this example, three MRDs 100 are mounted to base plate 200, with the tops of male connectors 220 of the MRDs 100 engaged with, and restrained by, deflecting component 120 of the base plate 100. As mentioned previously, any variety of accessory holders may be mounted to base plate 100, and MRD 200, or other accessory holder(s), may be mounted to various carriers.

In the configuration shown in FIG. 5, the base plate 100 has a front face 150 and the MRD 200 has a back face (not shown) that are substantially flush with one another when the male connector 220 is seated in the female track 120.

As also shown in FIGS. 1, 2 and 5, the release mechanism may include at least one deflecting component 122, shown at the tops of the female tracks, integrally formed or joined with the base plate 100, or other carrier, and configured to be manipulated by a user's finger to allow an accessory holder to be removed from the base plate 100. Deflecting component 122 can be seen in FIGS. 5 and 6 holding the tops of male connectors 220. In some embodiments, a user can simply press these deflecting component 122 (e.g. from the front of base plate 100) to release the male tracks to remove the accessory holder.

Figure 6:
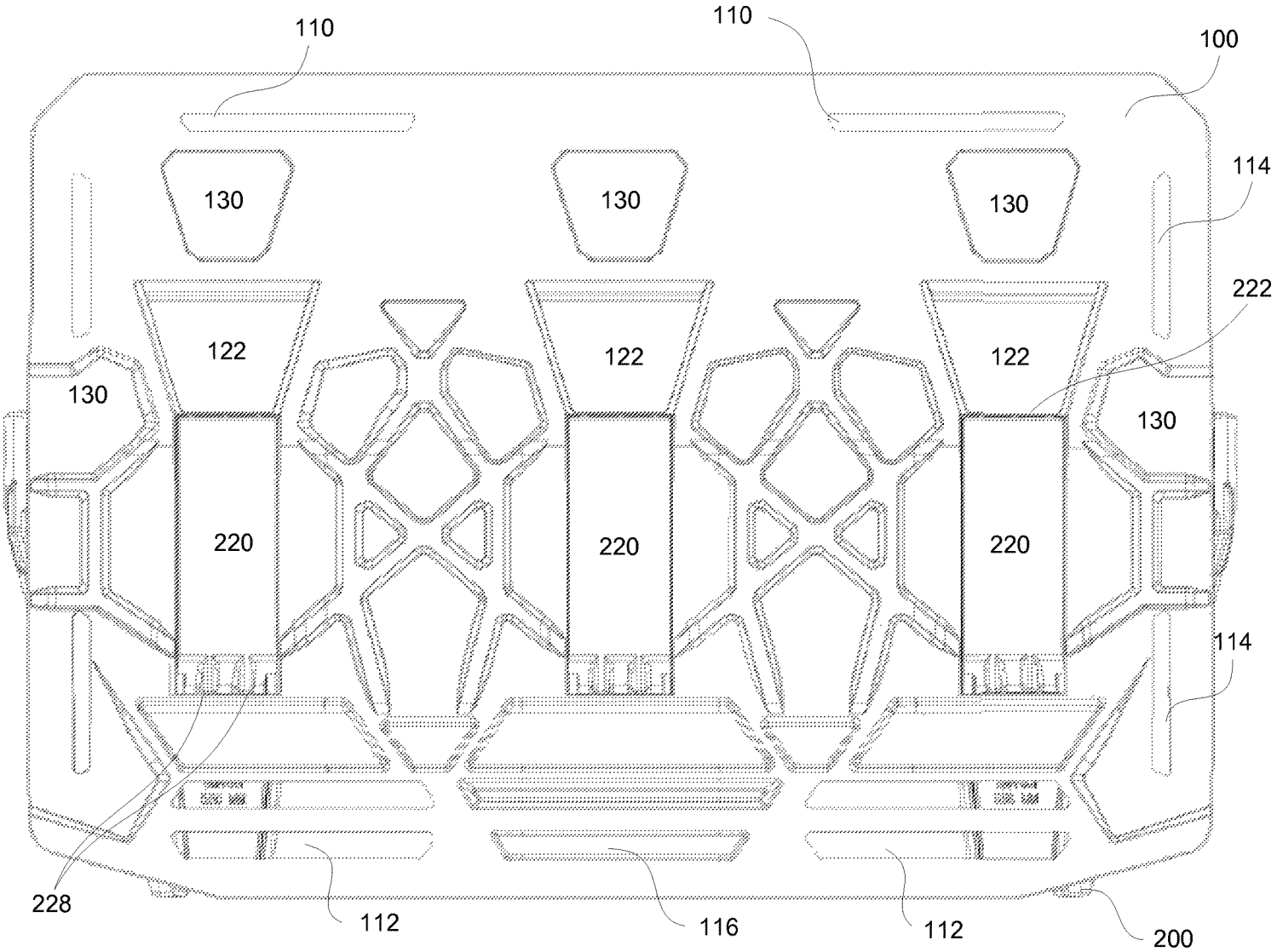
FIG. 6 is a rear view, showing additional details of the carrier plate and firearm magazine holders shown in FIG. 5.

FIG. 6 is a back view of the carrier shown in FIGS. 1 and 2. As shown in FIG. 6, the male connector 220 may be seated in female connector slot 120 with the stops 228 seated at the bottom of the slot 120 and the top edge 222 held by the deflecting component 122. As also shown in FIG. 6, the backside of the base plate 100 may have pockets 130, e.g. positioned to receive hook or loop material which assist in holding the base plate 100 inside a kangaroo pouch of a load bearing vest, or other carrier. Similar pockets may be disposed on the front face as well.

Figure 7:
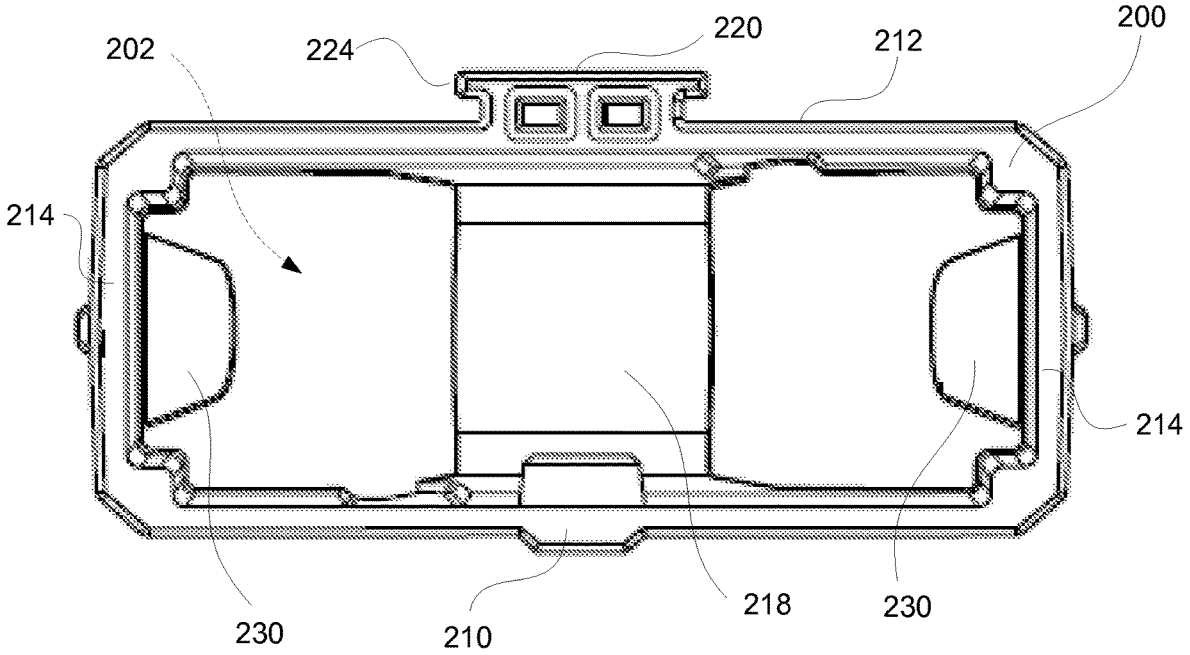
FIG. 7 is a top view, showing additional details of the firearm magazine holder shown in FIG. 3.
Figure 8:
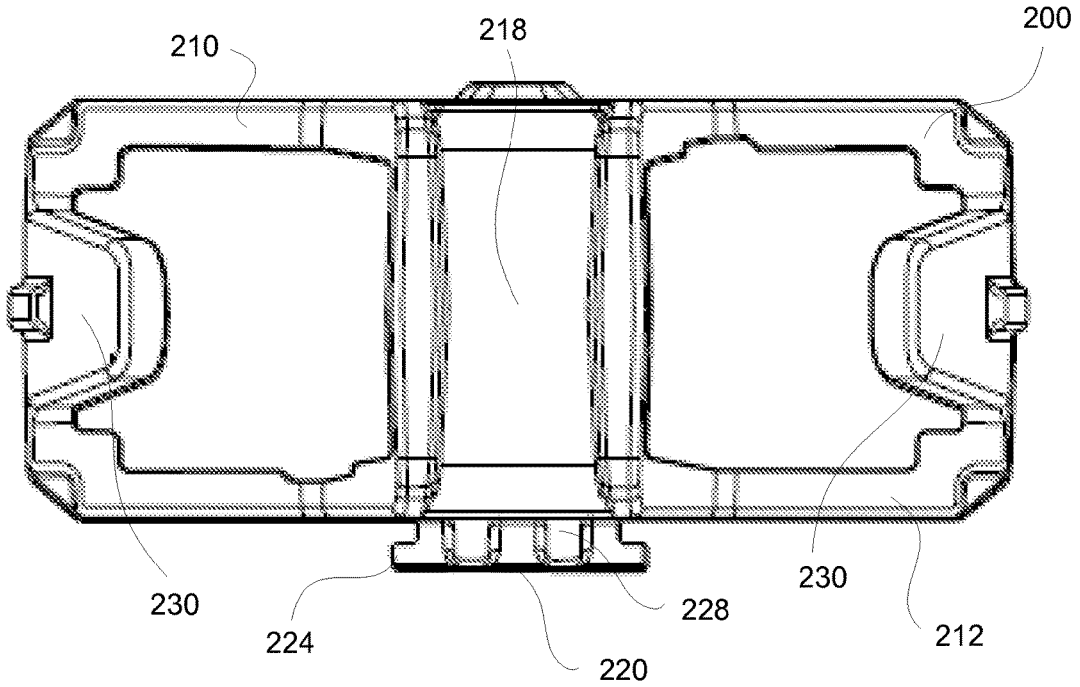
FIG. 8 is a bottom view, showing additional details of the firearm magazine holder shown in FIG. 3.

FIG. 7 shows a top view of the MRD 200, showing the (back) surface that mounts toward the carrier and that includes the male connector 220 toward the top of the figure. FIG. 8 shows a bottom view of the MRD 200, showing the (back) surface that mounts toward the carrier and that includes the male connector 220 toward the bottom of the figure. As can be seen in FIGS. 7 and 8, the deflecting flanges 230 encroach into the area defined by opening 202 and, when the accessory is inserted through the opening 202 and into the cavity of the MRD 200, the flanges 230 will be pushed outward, pinching the accessory between them.

Figure 9:
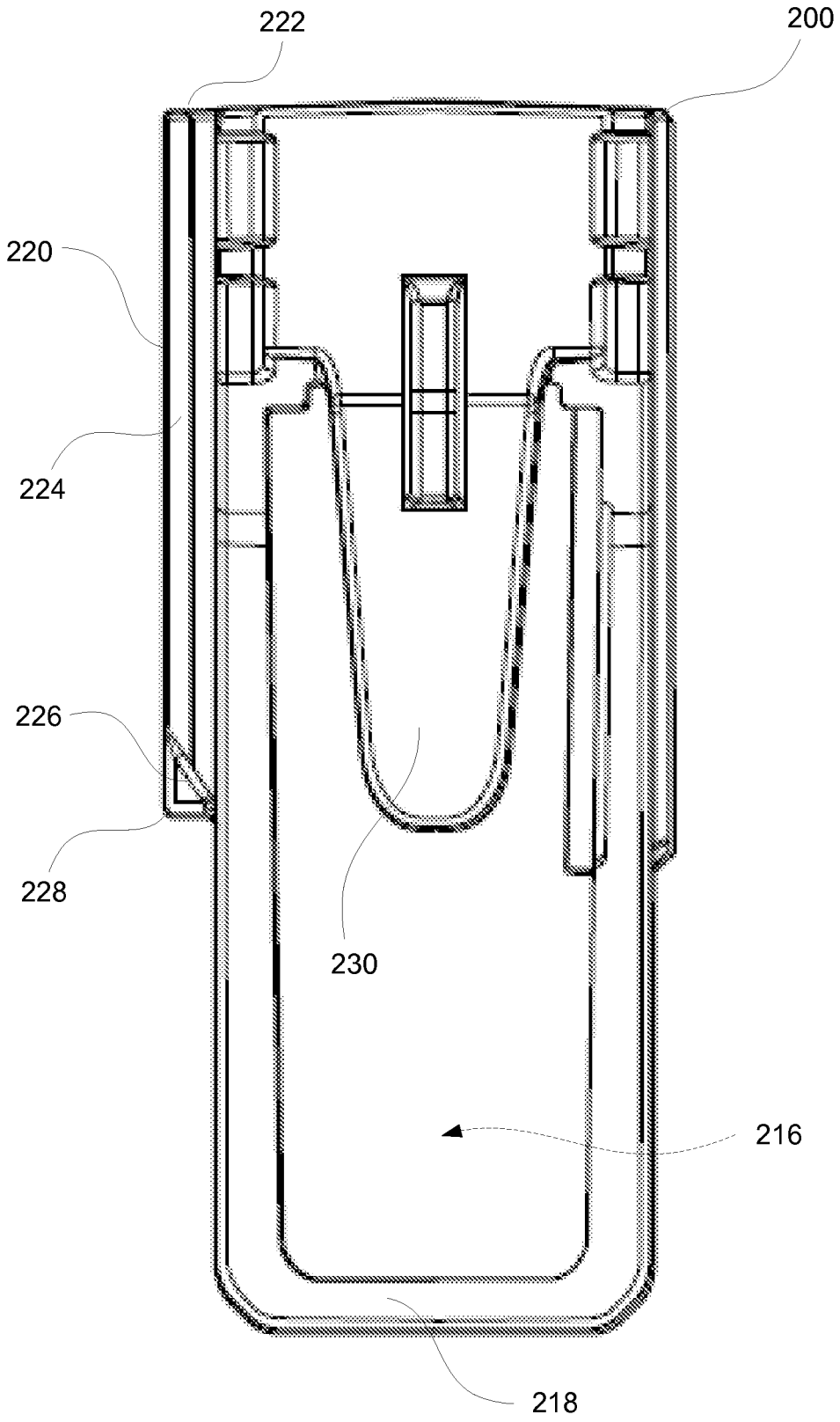
FIG. 9 is a side view, showing additional details of the firearm magazine holder shown in FIG. 3.

FIG. 9 shows a side view of the MRD 200, showing the surface that mounts toward the carrier and that includes the male connector 220 toward the left side of the figure.

As will appreciated considering FIGS. 3, 4 and 7-9, the MRD 200, or other accessory holder, may be configured with a limited amount of material and allow for many open areas that reduce weight, prevent water retention, and isolate the retention surfaces to those specifically intended to contact the magazine and/or accessory. For example, unlike other substantially closed magazine holders, there is a significant reduction in the amount of debris, mud and/or liquid that is kept in contact with the magazine, which can help reduce the chance of fouling the magazine and rounds contained therein.

In embodiments, the frame of the accessory holder, such as MRD 200, may include at least one interior surface with a friction-enhancing treatment and/or friction-enhancing material facing the cavity. For example, any of the top, bottom, left, or right interior walls and/or edges shown in FIG. 3 or 7, may include a friction-enhancing treatment and/or friction-enhancing material on the corresponding surface facing the opening 202 or open well 216. Preferably, less than all, or one, of the interior surfaces facing the opening/cavity includes the friction-enhancing treatment and/or material, such as rubber, or other material or treatment.

As also shown in FIG. 7, the opening 202, and associated cavity, may have a substantially rectangular cross section, and the opening 202 or open well 216 may include a friction-enhancing treatment and/or material on an interior surface extending through one edge of the rectangle, such as on front wall 210 or back wall 212. In embodiments, the frame may not include the friction-enhancing treatment and/or material on interior surfaces extending through the other three edges of the rectangle, such as side walls 214 and one of front wall 210 or back wall 212.

The MRD 200 may be configured as an individual magazine (or other accessory) retention device that uses tension which is directed perpendicularly to the short walls of the magazine or other body. These surfaces (e.g. 230) may be angled, such as shown in FIG. 4, to smoothly receive the magazine (or other accessory) during insertion and then hold tension after the magazine is completely inserted. It may also use, for example, a small strip of rubberized, or other friction enhancing, material to provide surface friction across one of the long walls of the magazine body, e.g. along the front wall 210 or back wall 212 of the MRD 200. The combination of tensions along the two short walls and singular long outer walls of the magazine body provide significant force that retains a 30 round magazine in a fixed position.

In embodiments, e.g. where the base plate or other carrier has a tracked groove, it can be used to accommodate a variety of different options (e.g. different magazine types & sizes).

Figure 10B:
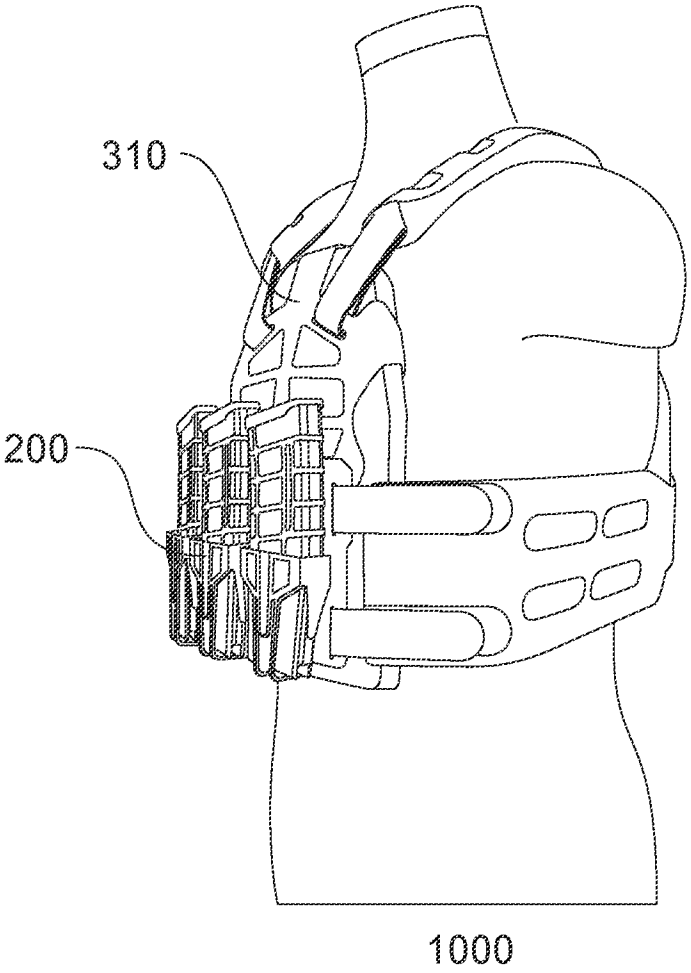
FIGS. 10A and 10B are views of an exemplary body armor carrier plate and harness with several firearm magazine holders attached thereto according to aspects of the invention.
Figure 10A:
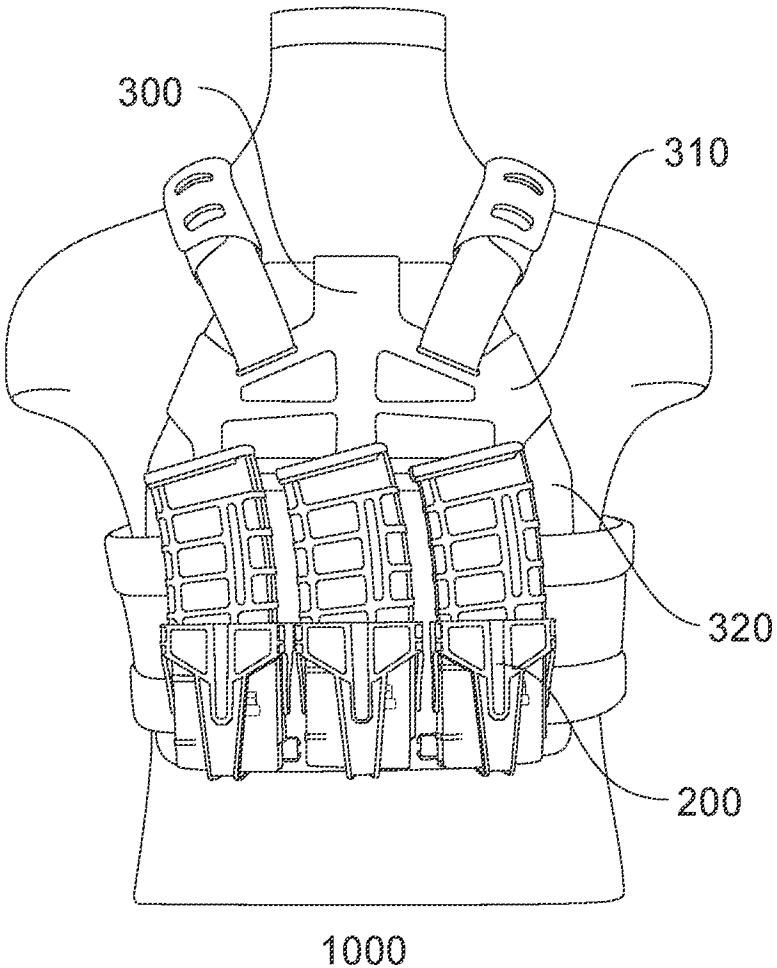

FIGS. 10A and 10B show front and side views of an exemplary system 1000 as worn by a user, including an integrated armor plate carrier harness 300 and MRDs 200 holding individual firearm magazines. In the example shown in FIGS. 10A and 10B, the MRDs 200 may be connected directly to the armor plate carrier harness 300 via connectors integrated in the armor plate carrier harness 300, or a carrier plate, such as carrier plate 100, may be connected to the armor plate carrier harness 300 and the MRDs 200 connected to the carrier plate, as previously described. The armor plate carrier harness 300 may include various features as described, for example, in US Patent Publication 2013/0084764, entitled "Plate Carrier Apparatus and Method," the contents of which are hereby incorporated by reference in their entirety.

Armor plate carrier harness 300 may include a front and/or back plate frame 310 made of a rigid piece of material that securely grabs and retains a ballistic body armor plate 320. The plate frame 310 acts as a carrier of the body armor plate 320 and may frame and/or partially enclose the body armor plate 320. The plate frame 310 may have unnecessary material removed to decrease the weight that is loaded on the user. The plate frame 310 could, for example, be made out of plastic, metal, and/or any other non-porous rigid material. By making the plate frame 310 out of these types of material, the plate frame may be liquid, chemical, and biohazard resistant. These types of material can be easily decontaminated. Forming the plate frame 310 from these types of material also can eliminate extra weight being added to the material when the plate frame is submerged in water.

The plate frame 310 may generally correspond to the size, shape, and curvature of the body armor plate 320. To attach the body armor plate 320 to the plate frame 310, one or more tabs attached to the plate frame 310 may be used to clamp around the outer edges of the body armor plate 320 to retain the body armor plate with (and in some embodiments, within) the plate frame 310. Tabs, or other retaining means, may bend back to allow the body armor plate 320 to be inserted in the plate frame 310 and housed between the tabs and the inside of the plate frame 310 so that the tabs, which may also be termed "hooks," may hook or wrap around a portion of the body armor plate to secure it to or partially within the plate frame 310. In some examples, the body armor plate 320 may be secured to the plate frame 310 via adjustable tabs that are configured with preconfigured adjustable positions, such as by using a flexible tooth opposed to fixed spaced-apart teeth, ratcheted detents, etc.

Figure 11B:
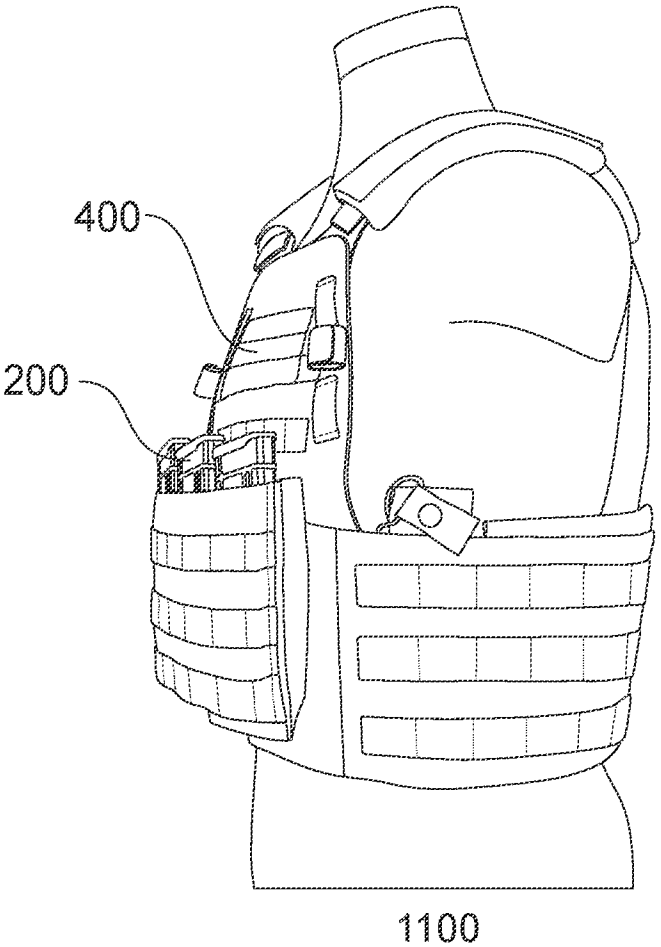
FIGS. 11A and 11B are views of another exemplary body armor carrier plate and harness with several firearm magazine holders and additional MOLLE holders attached thereto according to aspects of the invention.
Figure 11A:
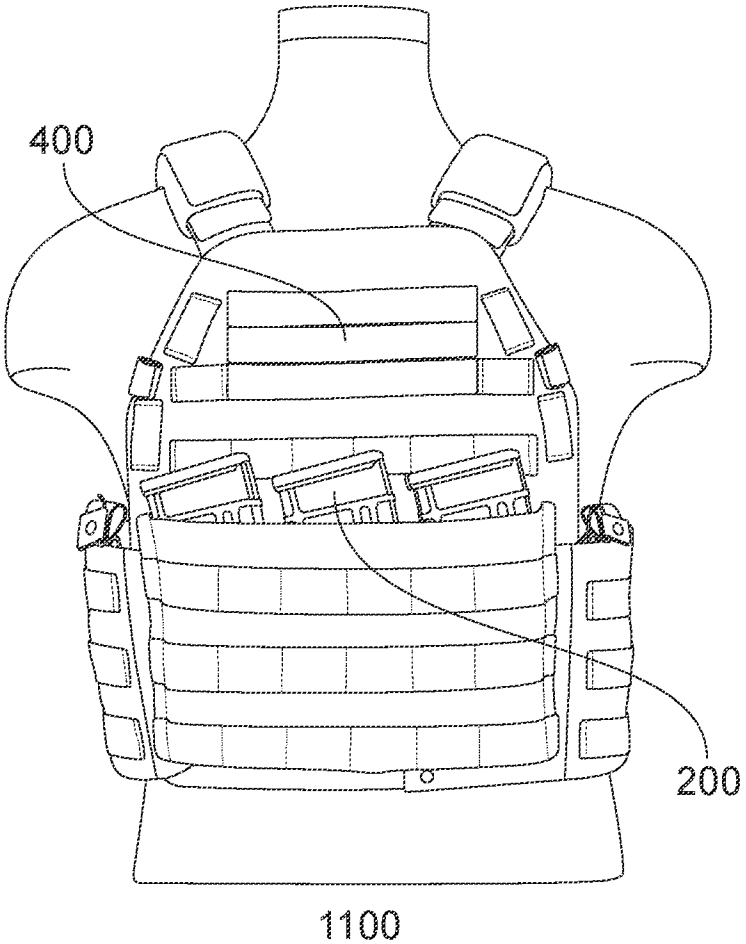

FIGS. 11A and 11B show front and side views of an exemplary system 1100 as worn by a user, including a chest harness 400 and three MRDs 200 holding individual firearm magazines contained in a "kangaroo pouch." As mentioned previously, hook and/or loop fabric, or other attachment mechanisms, may be included on or attached to the exterior surface(s) of the MRD 200 or other accessory holder to easily secure the holder in a pouch or other carrier with complimentary attachment fabric/mechanisms. In embodiments, webbing, attachment straps, pouches, etc., be made of a polyvinyl chloride ("PVC") coated nylon, a vinyl-coated polyester or cordura or ripstop fabric, a two-way or four-way stretch nylon and Spandex blend, and/or a polyester mesh. These materials are merely example materials and not limiting of the materials from which these components may be made, and can be a non porous, liquid and/or chemical resistant fabric.

Figure 12:
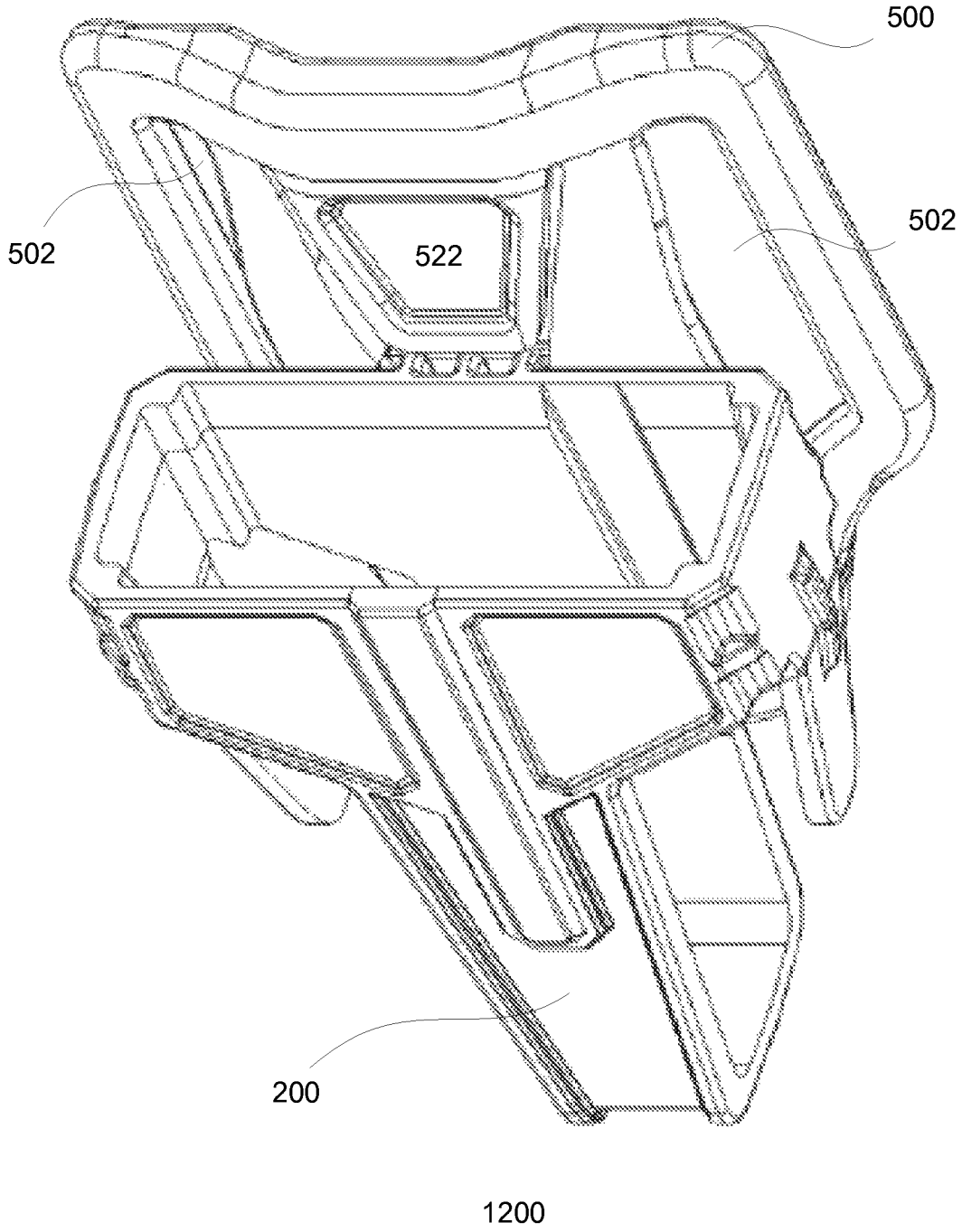
FIG. 12 is an isometric view of an exemplary belt carrier with an accessory holder attached thereto according to aspects of the invention.

Exemplary embodiments may also be adapted into, for example, a belt system that could receive MRD 200 or other accessory holders such as pistol holsters, weapon retention and any number of devices using a similar track system. An example of a belt system 1200 is shown in FIG. 12, which includes a single belt attachment carrier 500, holding a single MRD 200. A retention/release component 522, which may be similar to deflecting component 122, holds the MRD 200 to the belt attachment carrier 500. Belt attachment carrier 500 is shown with one set of openings 502 for receiving a belt or webbing there through. However, other examples of belt and/or MOLLE systems including multiple belt attachments and/or holding multiple accessory holders are also envisioned.

Track systems such as those described herein may also provide for the first connector and second connector being configured to resist rotation relative to one another when the first connector and second connector are engaged. For example, when the male track is seated in the female track, the accessory holder may be inhibited from rotating relative to the carrier.

While various embodiments have been described above, it is to be understood that the examples and embodiments described above are for illustrative purposes only and that various modifications or changes in light thereof will be suggested to persons skilled in the art, and are to be included within the spirit and purview of this application and scope of the appended claims. Therefore, the above description should not be understood as limiting the scope of the invention as defined by the claims.

What is claimed is:

1. A system for carrying accessories, comprising:

a carrier configured for at least one of wearing on a user's body or mounting to tactical equipment;

an accessory holder configured to attach to the carrier via a first connector fixedly attached to the accessory holder, and a second connector fixedly attached to the carrier; and a release mechanism for releasing the accessory holder from the carrier, wherein, the first connector and second connector are configured to engage with one another so as to allow the accessory holder to be mounted to and removed from the carrier, the first connector and second connector are attachable to one another using a male member of the first connector and a female member of the second connector, and the first connector and second connector are configured to resist rotation relative to one another when the first connector and the second connector are engaged, the release mechanism includes at least one deflecting component connected to the carrier, the at least one deflecting component configured to deflect as the first connector begins to engage with the second connector and to be manipulated by a user's finger to allow the accessory holder to be removed from the carrier, the second connector is a female style track having the deflecting component disposed at the top of the female style track, the first connector is a male style track connector with a top edge, side rails and a chamfered edge, the side rails being complementary to the sides of the female style track, the chamfered edge is a lead-in edge that is configured to deflect the deflecting component during attachment, the top edge being configured to positively engage the deflecting component in a fully seated position, and the accessory holder is configured to receive and fixedly hold at least one of a firearm, a firearm magazine, a radio, or a grenade.

2. The system of claim 1, wherein the at least one deflecting component is included as part of the second connector, and the carrier is at least one of a chest plate, a side plate, a back plate, a load bearing equipment, a belt, a vest, a ballistic plate carrier, a backpack, a harness, or a holster.

3. The system of claim 1, wherein the second connector is a monolithic piece of material that is at least one of molded, machined, cast, or 3-D patterned, and that is affixed to the carrier.

4. The system of claim 1, wherein the accessory holder comprises a top opening and a plurality of elongated members extending from a wall of the top opening and at least partially defining a well in which an accessory is received, at least one of the elongated members having a free end that is angled toward a middle of the opening, and configured to deflect via contact with the accessory when the accessory is received in the well and to maintain a positive pressure on the accessory when the accessory is received in the well, and wherein the well is configured to receive and fixedly hold at least one of a firearm magazine, a radio, a tool, a grenade, a weapon system, ordnance, or tactical equipment.

5. The system of claim 1, wherein the accessory holder is a monolithic piece of material that is at least one of molded, machined, cast, or 3-D patterned.

6. The system of claim 1, wherein each of the accessory holder and the second connector are monolithic pieces of material that are at least one of molded, machined, cast, or 3-D patterned.

7. The system of claim 1, wherein the carrier includes a plurality of slots configured to receive straps therethrough and disposed around a perimeter of the carrier, and a plurality of second connectors arranged in fixed positions on the carrier and configured to mount a plurality of accessory holders thereto.

8. The system of claim 1, wherein the carrier is plate-shaped and includes the second connector, the female member and the release mechanism, all of which are integrally made of a substantially monolithic piece of material that is at least one of molded, machined, cast, or 3-D patterned.

9. The system of claim 1, wherein the accessory holder is configured to resist rotation relative to the carrier when attached to the carrier.

10. The system of claim 1, wherein the carrier has a front face and the accessory holder has a back face that are flush with one another when the male member is seated in the female member, and the accessory holder and the carrier are configured to allow the at least one deflecting component to be manipulated by a user's finger from a direction of the carrier's front face with the accessory holder attached to the carrier.

11. The system of claim 1, wherein the accessory holder includes a top opening configured to receive the at least one of a firearm, a firearm magazine, a radio, or a grenade.

12. The system of claim 1, wherein the accessory holder is configured to receive and fixedly hold a firearm magazine.

13. A system for carrying accessories, comprising:

a carrier configured for at least one of wearing on a user's body or mounting to tactical equipment, the carrier including a front face and a back;

an accessory holder configured to attach to the front face of the carrier via a first connector fixedly attached to the accessory holder, and a second connector fixedly attached to the carrier; and a release mechanism for releasing the accessory holder from the carrier, wherein, the first connector and second connector are configured to engage with one another so as to allow the accessory holder to be mounted to and removed from the carrier, the first connector and second connector are attachable to one another using a male member of the first connector and a female member of the second connector, and the first connector and second connector are configured to resist rotation relative to one another when the first connector and the second connector are engaged, the release mechanism includes at least one deflecting component connected to the carrier, the at least one deflecting component configured to deflect as the first connector begins to engage with the second connector and to be manipulated by a user's finger from a direction of the carrier's front face with the accessory holder attached to the carrier to allow the accessory holder to be removed from the carrier, the second connector is a female style track having the deflecting component disposed toward a top of the female style track, the first connector is a male style track connector with a top edge, side rails and a chamfered edge, the side rails being complementary to the sides of the female style track, the chamfered edge is a lead-in edge that is configured to deflect the deflecting component during attachment, the top edge being configured to positively engage the deflecting component in a fully seated position, and the accessory holder is configured to receive and hold at least one of a firearm, a firearm magazine, a radio, or a grenade.

14. The system of claim 13, wherein the at least one deflecting component is configured to deflect toward the back of the carrier during attachment, and to return toward the front face of the carrier in the fully seated position.

15. The system of claim 13, wherein the accessory holder includes a top opening configured to receive the at least one of a firearm, a firearm magazine, a radio, or a grenade.

16. The system of claim 13, wherein the accessory holder is configured to receive and hold a firearm magazine.

17. A system for carrying accessories, comprising:

a carrier configured for at least one of wearing on a user's body or mounting to tactical equipment;

an accessory holder configured to attach to the carrier via a first connector fixedly attached to the accessory holder, and a second connector fixedly attached to the carrier; and a release mechanism for releasing the accessory holder from the carrier, wherein, the first connector and second connector are configured to engage with one another so as to allow the accessory holder to be mounted to and removed from the carrier, the first connector and second connector are attachable to one another using a male member of the first connector and a female member of the second connector, and the first connector and second connector are configured to resist rotation relative to one another when the first connector and the second connector are engaged, the release mechanism includes at least one deflecting component connected to the carrier, the at least one deflecting component configured to deflect as the first connector begins to engage with the second connector and to be manipulated by a user's finger to allow the accessory holder to be removed from the carrier, the second connector is a female style track having the deflecting component disposed at the top of the female style track, the first connector is a male style track connector with a top edge, side rails and a chamfered edge, the side rails being complementary to the sides of the female style track, the chamfered edge is a lead-in edge that is configured to deflect the deflecting component during attachment, the top edge being configured to positively engage the deflecting component in a fully seated position, and the accessory holder comprises a top opening and a plurality of elongated members extending from a wall of the top opening and at least partially defining a well in which an accessory is received, at least one of the elongated members having a free end that is angled toward a middle of the opening, and configured to deflect via contact with the accessory when the accessory is received in the well and to maintain a positive pressure on the accessory when the accessory is received in the well.

18. The system of claim 17, wherein the well is configured to receive and hold at least one of a firearm, a firearm magazine, a radio, or a grenade.

* * * * *